United States Patent [19]

Kamata et al.

[11] Patent Number: 4,814,248

[45] Date of Patent: Mar. 21, 1989

[54] PHOTOCONDUCTIVE MEMBER AND SUPPORT FOR SAID PHOTOCONDUCTIVE MEMBER

[75] Inventors: Naoko Kamata, Tokyo; Tadaji Fukuda, Yokohama, both of Japan

[73] Assignee: Canon Kabushiki Kaisha, Tokyo, Japan

[21] Appl. No.: 154,462

[22] Filed: Feb. 8, 1988

Related U.S. Application Data

[63] Continuation of Ser. No. 63,792, Jun. 22, 1987, abandoned, which is a continuation of Ser. No. 873,153, Jun. 9, 1986, abandoned, which is a continuation of Ser. No. 782,143, Sep. 30, 1985, abandoned, which is a continuation of Ser. No. 598,973, Apr. 11, 1984, abandoned.

[30] Foreign Application Priority Data

Apr. 14, 1983 [JP] Japan ..... 58-64525

[51] Int. Cl.[4] ..... G03G 5/10

[52] U.S. Cl. ..... 430/69; 29/132; 355/3 DR

[58] Field of Search ..... 430/69

[56] References Cited

U.S. PATENT DOCUMENTS

| | | | |
|---|---|---|---|
| 4,265,991 | 5/1981 | Hirai et al. | 430/65 X |
| 4,405,703 | 9/1983 | Onuma et al. | 430/69 |
| 4,464,451 | 8/1984 | Shirai et al. | 430/65 |
| 4,466,380 | 8/1984 | Jansen et al. | 427/39 X |

*Primary Examiner*—J. David Welsh

*Attorney, Agent, or Firm*—Fitzpatrick, Cella, Harper & Scinto

[57] ABSTRACT

A photoconductive member comprises a drum-shaped substrate and a photoconductive layer which is provided on the drum-shaped substrate and contains an amorphous material comprising silicon atoms as a matrix, and said drum-shaped substrate has a thickness of 2.5 mm or more.

23 Claims, 1 Drawing Sheet

PHOTOCONDUCTIVE MEMBER AND SUPPORT FOR SAID PHOTOCONDUCTIVE MEMBER

This application is a continuation of application Ser. No. 063,792, filed June 22, 1987, now abandoned which, in turn, is a continuation of application Ser. No. 873,153, filed June 9, 1986, now abandoned, which in turn, is a continuation of application Ser. No. 782,143, filed on Sept. 30, 1985, now abandoned, which in turn, is a continuation of application Ser. No. 598,973 filed Apr. 11, 1984, now abandoned.

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Art

Photoconductive materials, which constitute image forming members for electrophotography in solid state image pick-up devices or in the field of image formation, or photoconductive layers in manuscript reading devices, are required to have a high sensitivity, a high SN ratio [Photocurrent $(I_p)/(I_d)$], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. Particularly, in case of an image forming member for electrophotography to be assembled in an electrophotographic device to be used in an office as office apparatus, the aforesaid harmless characteristic is very important.

From the standpoint as mentioned above, the photoconductive material which is attracting attention in recent years is an amorphous silicon (hereinafter referred to as a-Si) in which dangling bonds are modified with mono-valent elements such as hydrogen or halogen atoms. For example, German OLS Nos. 2746967 and 2855718 disclose applications of a-Si for use in image forming members for electrophotography, and German OLS No. 2933411 discloses an application of a-Si for use in a photoelectric transfer reading device. Such an amorphous silicon is expected to be applied for an image forming member for electrophotography due to its excellent photoconductivity, friction resistance, heat resistance and relative easiness in enlargement of area.

Generally speaking, in preparation of a photosensitive drum for electrophotography having a photoconductive material containing a-Si, in order to obtain good photoconductive characteristics, a-Si deposited film is formed on a drum-shaped substrate under the condition wherein the substrate is heated to a temperature of 200° C. or higher in a a-Si film deposition device.

However, because of the difference in coefficient of thermal expansion between the drum-shaped substrate and the a-Si film and also because of the great internal stress within the a-Si film, not only during deposition of the a-Si film when the drum-shaped substrate is heated as described above, but also during cooling after deposition, it is frequently recognized that the a-Si film is peeled off from the drum-shaped substrate.

According to a large number of experiments by the present inventors, such peeling of the film will occur more readily as the a-Si film is thicker. Also, even by deformation of the drum-shaped substrate to the extent which will not cause peeling in a Se type photosensitive drum for electrophotography of the prior art, peel-off of the film may be caused in the case of the a-Si photosensitive drum for the reasons as mentioned above, namely difference in coefficient of thermal expansion and greatness of internal stress within the a-Si film. As to the internal stress in the a-Si film, it can be alleviated to some extent by the preparation conditions of a-Si film (starting gases, discharging power, temperature for heating substrate, etc.). However, such a peel-off of the film is a vital disadvantage, causing image defect when employed as the photosensitive drum for electrophotography.

Also, heating of the drum-shaped substrate during preparation of a-Si film is not only a cause for the above film peel-off, but also generates readily thermal deformation of the drum-shaped substrate. The thermal deformation will cause unevenness in discharging during preparation of a-Si deposited film, whereby evenness in thickness of the a-Si deposited film is lost and image defect may be brought about.

The present invention has been accomplished in view of the various points as mentioned above, and as the result of extensive studies made comprehensively from the standpoints of applicability and utility of a-Si as a photoconductive member for image forming members for electrophotography, solid stage image pick-up devices, reading devices, etc., it has now been found that the above problems such as film peel-off can be overcome by use of a drum-shaped substrate having a specific thickness as the support for the a-Si deposited film.

SUMMARY OF THE INVENTION

An object of the present invention is to provide a photoconductive member for electrophotography which can give an image of high quality with little image defect such as white drop-off due to peel-off of the a-Si deposited film.

Another object of the present invention is to provide a photoconductive member which is constantly stable in electrical, optical and photoconductive characteristics and also excellent in durability without ensuing deteriorating phenomenon even when employed repeatedly.

According to the present invention, there is provided a photoconductive member comprising a drum-shaped substrate and a photoconductive layer which is provided on the drum-shaped substrate and contains an amorphous material comprising silicon atoms as a matrix, said drum-shaped substrate having a thickness of 2.5 mm or more.

DETAILED DESCRIPTION OF THE INVENTION

Figure 1:
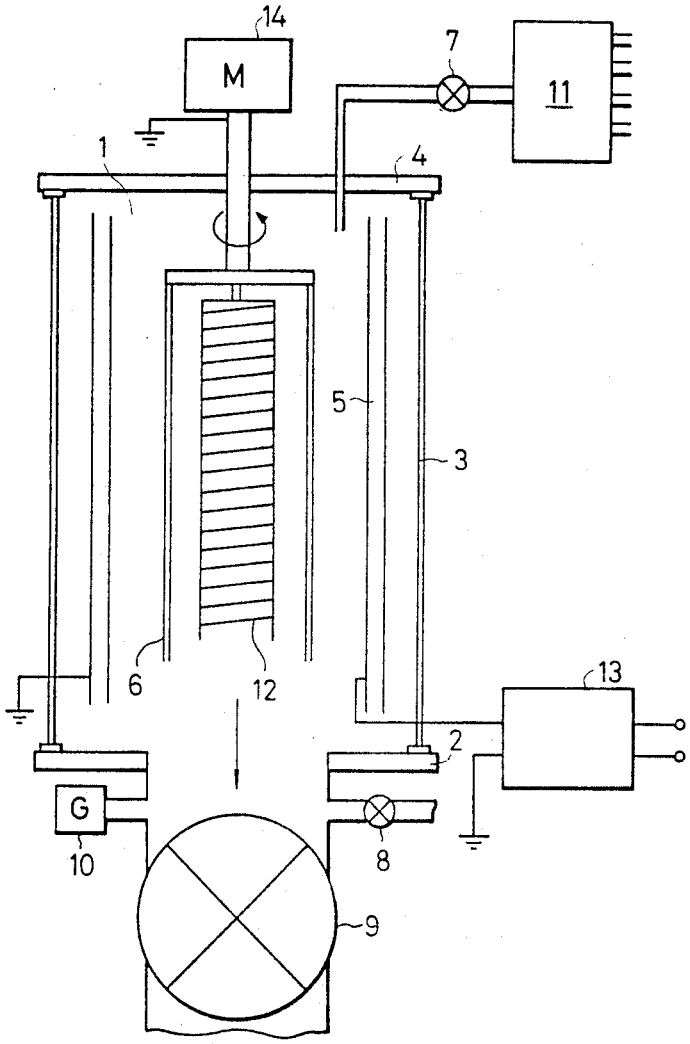
FIG. 1 shows a device for preparation of a photoconductive member according to the glow discharge decomposition method.

The photoconductive member of the present invention, according to its preferred embodiment, is constituted of a drum-shaped, namely cylindrical substrate as the support for a photoconductive member and a photoconductive member, provided on the drum-shaped substrate, which contains an amorphous material comprising silicon atoms as the matrix, preferably containing at least one of hydrogen atoms and halogen atoms as constituent atoms. Said photoconductive layer may have a barrier layer in contact with the drum-shaped substrate, and further a surface barrier layer on the surface of said photoconductive layer.

The drum-shaped substrate of the present invention has a thickness of 2.5 mm or more. That is, by use of a drum having a thickness of 2.5 mm or more, the extent of deformation of the drum-shaped substrate can be suppressed sufficiently small even when the drum-shaped substrate may be heated in a a-Si film depositing device during preparation of a photoconductive member or during use as the photosensitive drum for electrophotography, and therefore peel-off of the a-Si deposited film can be reduced within a practical range or avoided completely. More preferably, the drum-shaped substrate should have a thickness of 3.5 mm or more.

The base material for the drum-shaped substrate may be either electroconductive or insulating. As the electroconductive base material, there may be mentioned metals such as NiCr, stainless steel, Al, Cr, Mo, Au, Nb, Ta, V, Ti, Pt, Pd etc. or alloys thereof.

As the insulating base material, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating supports should preferably have at least one surface subjected to electroconductive treatment, and it is desirable to provide photoconductive layers on the side at which said electroconductive treatment has been applied.

For example, elecltroconductive treatment of a glass can be effected by providing a thin film of NiCr, Al, Cr, Mo, Au, Ir, Nb, Ta, V, Ti, Pt, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface.

As the base material for the drum-shaped substrate, it is preferred to use aluminum, because it can be relatively easily formed into a drum with good precision with respect to, for example, true circularity, surface smoothness, etc., easily controlled in temperature at the surface portion of a-Si deposited during preparation of the drum and is also advantageous in economical aspect.

Examples of the halogen atoms which may be contained in the photoconductive layer of the photoconductive member of the present invention may include fluorine, chlorine and fluorine, particularly preferably chlorine and fluorine, above all fluorine. As other components than silicon atoms, hydrogen atoms and halogen atoms to be contained in the photoconductive layer, there may be contained as the component for controlling the Fermi lebel or the forbidden band gap the group III atoms of the periodic table such as boron, gallium, etc., the group V atoms of the periodic table such as nitrogen, phosphorus, arsenic, etc., oxygen atoms, carbon atoms, germanium atoms, either singly or in a suitable combination.

A barrier layer is provided for the purposes such as improvement of adhesion between the photoconductive layer and the drum-shaped substrate or controlling of the charge receiving ability, and depending on the purpose, a-Si layer or microcrystalline-Si layer containing the group III atoms of the periodic table, the group V atoms of the periodic table, oxygen atoms, carbon atoms, germanium atoms is formed in one layer or in multi-layer.

Also, as the layer for preventing injection of surface charges or the protective layer, there may be provided an upper layer constituted of a-Si containing carbon atoms, nitrogen atoms, oxygen atoms, preferably in large amounts, or a surface barrier layer comprising a high resistance organic material.

In the present invention, for formation of the photoconductive layer constituted of a-Si, vacuum deposition methods utilizing discharging phenomenon known in the art may be applicable, such as the glow discharging method, and sputtering method or the ion plating method.

Next, an example of preparation of a photoconductive member formed according to the glow discharge decomposition method is described.

FIG. 1 shows a device for preparation of a photoconductive member according to the glow discharge decomposition method. The deposition tank 1 is constituted of a base plate 2, a tank wall 3 and a top plate 4. Within the deposition tank 1, a cathode 5 is provided and the drum-shaped substrate 6 is placed at the central portion of the cathode 5 and it also functions as the anode.

For formation of a-Si deposited film on the drum-shaped substrate by means of this preparation device, first with the inflow valve 7 for feed gas and the leak valve 8 being closed, the gas discharging valve 9 is opened to evacuate the deposition tank 1. When the reading on the vacuum indicator 10 becomes about $5\times10^{-6}$ Torr, the feed gas inflow valve 7 is opened to permit a starting gas mixture such as $SiH_4$ gas, $Si_2H_6$ gas, $SiF_4$ gas, etc. controlled at a desired mixing ratio in the massflow controller 11 to flow into the deposition tank 1. The opening of the gas discharging valve 9 is controlled while watching the reading on the vacuum indicator 10 so that the pressure in the deposition tank 1 may become a desired value. And, after confirming that the surface temperature on the drum-shaped substrate 6 has been set at a desired temperature by the heater 12, the high frequency power source 13 is set at a desired power to excite glow discharging in the deposition tank 1.

During layer formation, in order to uniformize layer formation, the drum-shaped substrate 6 is rotated by a motor 14 at a constant speed. Thus, a-Si deposited film can be formed on the drum-shaped substrate 6.

The present invention is described in detail by referring to the following Examples.

EXAMPLE 1

By means of the preparation device shown in FIG. 1, according to the glow discharge decomposition method as described in detail above, a-Si deposited films were formed on six kinds of aluminum drum-shaped substrates with an outer diameter of 80 mm having different thickness one another under the following conditions.

| Order of deposited layers | Starting gases employed | Layer thickness (μm) |
|---|---|---|
| First layer | $SiH_4$, $B_2H_6$ | 0.6 |

-continued

| | | |
|---|---|---|
| Second layer | $SiH_4$ | 20 |
| Third layer | $SiH_4$, $C_2H_4$ | 0.1 |
| Drum-shaped substrate temperature: | | 250° C. |
| Pressure in the deposition tank during formation of deposited layer: | | 0.03 Torr |
| Discharging frequency: | | 13.56 MHz |
| Deposited layer formation speed: | | 20 Å/sec |
| Discharging power: | | 0.18 W/cm$^2$ |

After the state of peel-off of the film on the photosensitive drum for electrophotography thus prepared was observed, each of these photosensitive drums was set on a copying device 400 RE produced by Canon, Inc. to carry out image formation, and the image formed was evaluated. The results are shown in Table 1.

When the true circularity was measured for the above photosensitive drums with thicknesses of 1.5 mm and 2.0 mm, the difference between the most recessed portion and the most protruded portion was approximately 100 μm. In contrast, for the photosensitive drums with thicknesses of 2.5 mm and 3.0 mm, the difference was about 30 μm, and for the photosensitive drums with thicknesses of 3.5 mm and 5.0 mm, it was 10 to 20 μm.

EXAMPLE 2

A photosensitive drum for electrophotography was prepared according to the same procedure as in Example 1 except for using $Si_2H_6$ gas in place of $SiH_4$ gas during formation of the second layer of the a-Si deposited film on an aluminum drum-shaped substrate with an outer diameter of 80 mm and a thickness of 3.0 mm. For the electrophotographic photosensitive drum, evaluation of peel-off of the film and image evaluation was conducted similarly as in Example 1. As the result, for both of the evaluations, good results were obtained similarly as in the case of the photosensitive drum with the thickness of 3.0 mm in Example 1.

TABLE 1

| Thickness | | 1.5 mm | 2.0 mm | 2.5 mm | 3.0 mm | 3.5 mm | 5.0 mm |
|---|---|---|---|---|---|---|---|
| Number of film peel-off | A*1 | 22 | 16 | 5 | 2 | 1 | 1 |
| | B*2 | 7 | 4 | 1 | 0 | 0 | 0 |
| Image evaluation | | X | X | Δ | ○ | ◎ | ◎ |

Standards for image evaluation:
◎ Very good
○ Good
Δ Practically no problem
X Practically with problem
A*1: Size of the peeled portion 0.3 mm ≦ ϕ ≦ 0.6 mm
B*2: Size of the peeled portion 0.6 mm ≦ ϕ

What is claimed is:

1. A photoconductive member for electrophotography comprising a drum-shaped substrate and a photoconductive layer which is provided on the drum-shaped substrate and contains an amorphous material comprising silicon atoms as a matrix, said drum-shaped substrate having a thickness of 2.5 mm or more.

2. A photoconductive member according to claim 1, wherein hydrogen atoms are contained in the photoconductive layer.

3. A photoconductive member according to claim 1, wherein halogen atoms are contained in the photoconductive layer.

4. A photoconductive member according to claim 1, wherein atoms belonging to the group III of the periodic table are contained in the photoconductive layer.

5. A photoconductive member according to claim 4, wherein atoms belonging to the group III of the periodic table contained in the photoconductive layer are atoms of boron or gallium.

6. A photoconductive member according to claim 1, wherein atoms belonging to the group V of the periodic table are contained in the photoconductive layer.

7. A photoconductive member according to claim 6, wherein atoms belonging to the group V of the periodic table contained in the photoconductive layer are atoms of nitrogen, phosphorus or arsenic.

8. A photoconductive member according to claim 1, wherein oxygen atoms are contained in the photoconductive layer.

9. A photoconductive member according to claim 1, wherein carbon atoms are contained in the photoconductive layer.

10. A photoconductive member according to claim 1, wherein germanium atoms are contained in the photoconductive layer.

11. A photoconductive member according to claim 1, wherein a barrier layer is further provided between the substrate and the photoconductive layer.

12. A photoconductive member according to claim 11, wherein atoms belonging to the group III of the periodic table are contained in the barrier layer.

13. A photoconductive member according to claim 11, wherein atoms belonging to the group V of the periodic table are contained in the barrier layer.

14. A photoconductive member according to claim 11, wherein oxygen atoms are contained in the barrier layer.

15. A photoconductive member according to claim 11, wherein carbon atoms are contained in the barrier layer.

16. A photoconductive member according to claim 11, wherein germanium atoms are contained in the barrier layer.

17. A photoconductive member according to claim 11, wherein the barrier layer comprises an amorphous silicon.

18. A photoconductive member according to claim 11, wherein the barrier layer comprises a microcrystalline silicon.

19. A photoconductive member according to claim 1, wherein an upper layer comprising either one of carbon atom, nitrogen atom and oxygen atom is further provided on the photoconductive layer.

20. A photoconductive member according to claim 1, wherein a surface barrier layer is further provided on the photoconductive layer.

21. A photoconductive member according to claim 1, wherein the drum-shaped substrate is made of NiCr, stainless steel, Al, Cr, Mo, Au, Nb, Ta, V, Ti, Pt, Pd or alloys thereof.

22. A photoconductive member according to claim 1, wherein the drum-shaped substrate is made of ceramics.

23. A photoconductive member according to claim 22 wherein the surface of the drum-shaped substrate to be provided with the photoconductive layer has electroconductivity.

* * * * *

UNITED STATES PATENT AND TRADEMARK OFFICE

CERTIFICATE OF CORRECTION

PATENT NO. : 4,814,248

DATED : March 21, 1989

INVENTOR(S) : NAOKO KAMATA, ET AL.

It is certified that error appears in the above-identified patent and that said Letters Patent is hereby corrected as shown below:

COLUMN 3

Line 56, "chlorine and fluorine," should read --chlorine, bromine and iodine,--.

Signed and Sealed this

Twenty-first Day of November, 1989

*Attest:*

JEFFREY M. SAMUELS

*Attesting Officer* *Acting Commissioner of Patents and Trademarks*